US006155729A

United States Patent [19]

Ishida et al.

[11] Patent Number: 6,155,729

[45] **Date of Patent: *Dec. 5, 2000**

[54] INK RIBBON FEED THAT EQUALIZES RIBBON TENSION OVER THE ENTIRE INK RIBBON WIDTH

[75] Inventors: Kazuhito Ishida, Ichinomiya; Hideo Nishigaki, Nagoya, both of Japan

[73] Assignee: Brother Kogyo Kabushiki Kaisha, Nagoya, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 09/110,873

[22] Filed: Jul. 7, 1998

Related U.S. Application Data

[63] Continuation-in-part of application No. 08/996,205, Dec. 22, 1997.

[30] Foreign Application Priority Data

Jan. 8, 1997 [JP] Japan ..... 9-1291
Jan. 7, 1998 [JP] Japan ..... 10-001767

[51] Int. Cl.[7] ..... B41J 35/08

[52] U.S. Cl. ..... 400/234; 400/248

[58] Field of Search ..... 400/234, 208, 400/248

[56] References Cited

U.S. PATENT DOCUMENTS

| | | | |
|---|---|---|---|
| 3,291,043 | 12/1966 | Bernard | 101/96 |
| 3,889,893 | 6/1975 | Silverman et al. | 242/420.5 |
| 4,096,417 | 6/1978 | Chambolle | 318/7 |
| 4,591,283 | 5/1986 | Hilpert | 400/248 |
| 5,160,205 | 11/1992 | Mistyurik | 400/248 |
| 5,297,879 | 3/1994 | Oikawa | 400/234 |
| 5,342,131 | 8/1994 | Nakajima et al. | 400/234 |
| 5,507,582 | 4/1996 | Mistyurik | 400/120.16 |
| 5,709,488 | 1/1998 | Imai et al. | 400/234 |
| 5,779,373 | 7/1998 | Tukahara et al. | 400/234 |
| 5,820,277 | 10/1998 | Schulte | 400/223 |
| 5,993,091 | 11/1999 | Ishida et al. | 400/234 |

FOREIGN PATENT DOCUMENTS

| | | |
|---|---|---|
| 58-16866 | 1/1983 | Japan . |
| 64-45672 | 2/1989 | Japan . |
| 9-193520 | 7/1997 | Japan . |
| 9-234892 | 9/1997 | Japan . |
| 1498367 | 1/1978 | United Kingdom . |

OTHER PUBLICATIONS

Patent Abstract of Japan, Publication No. 60250976, 12–11–85.

Patent Abstracts of Japan, Publication No. 63 135276, Jul. 6, 1988.

*Primary Examiner*—Edgar Burr
*Assistant Examiner*—Daniel J. Colilla
*Attorney, Agent, or Firm*—Oliff & Berridge, PLC

[57] ABSTRACT

An ink ribbon feeder for use in a facsimile machine has a feed roll winding thereover an ink ribbon and a take-up roll for taking-up the ink ribbon fed from the feed roll. A friction mechanism is provided at one end of the take-up roll for rotating the take-up roll in a taking-up direction. A back tension mechanism is provided at one end of the feed roll for rotating the feed roll in a direction opposite the taking-up direction. The friction mechanism and the back tension mechanism are provided at the same side of the ink ribbon. A separation segment is provided between the feed roll and the take-up roll and is positioned below the ink ribbon and in contact therewith. The separation segment has a sliding surface extending in a widthwise direction of the ink ribbon. A height of one and another ends of the sliding surface is different from each other.

16 Claims, 7 Drawing Sheets

INK RIBBON FEED THAT EQUALIZES RIBBON TENSION OVER THE ENTIRE INK RIBBON WIDTH

CROSS-REFERENCE TO THE RELATED APPLICATION

The present application is a continuation in part of U.S. patent application Ser. No. 08/996,205 filed Dec. 22, 1997.

BACKGROUND OF THE INVENTION

1. Field of the Invention

The present invention relates to an ink ribbon feed mechanism of a thermal recording type printing apparatus such as a facsimile machine and the like, and more particularly, to an ink ribbon feed arrangement that equalizes a ribbon tension over an entire ink ribbon width.

2. Description of Related Art

In a facsimile apparatus which is one example of a thermal recording type printing apparatus, an ink ribbon for recording is placed in the path of travel of recording paper (generally, a plain paper). The ink ribbon is usually wound on a feed roll, and printing is performed while the ink ribbon is being taken up onto a take-up roll. The ink ribbon is held stretched between the feed roll and the take-up roll. The recording paper and a recording head are provided in confronting relation interposing therebetween the ink ribbon. With heating the recording head, the ink coated on the ink ribbon melts to be transferred onto the recording paper.

FIG. 14 is a plan view showing an ink ribbon feed mechanism used in a conventional facsimile apparatus. In FIG. 14, an ink ribbon 101 is wound on a feed roll 102, and the leading end of the ink ribbon 101 is wound on a take-up roll 103. The take-up roll 103 rotates in the direction of an arrow Y in the drawing. That is, the ink ribbon 101 advances in the direction of an arrow X in the drawing, while being taken up on the take-up roll 103. The feed roll 102 and the take-up roll 103 are both supported nearly horizontally in relation to a bottom plate (not shown) of the facsimile apparatus by support frames 106A and 106B extending perpendicularly from the bottom plate.

The take-up operation of the ink ribbon 101 is effected by a friction mechanism 105 which drives the take-up roll 103. The friction mechanism 105 has a driving gear 108 which meshes with a gear 107 coaxially mounted on one end (on the right side in FIG. 14) of a spindle 103A of the take-up roll 103. To this driving gear 108 a controlled driving force is imparted. With the rotation of the driving gear 108, the take-up roll 103 rotates in the direction of the arrow Y, taking up the ink ribbon 101. However, if the rotational speed of the driving gear 108 is fixed, the amount of the ink ribbon 101 taken up on the take-up roll 103 increases (namely, the take-up roll 103 taking up the ink ribbon 101 becomes larger in diameter), increasing the take-up speed of the ink ribbon 101. There occurs, therefore, a difference in rotational speed between the take-up roll 103 and a platen roller (not shown) which carries recording paper. When a frictional force over a specific value is applied to the driving gear 108, or when the amount of the ink ribbon 101 wound on the take-up roll 103 has increased and a load to rotate the take-up roll 103 has increased over a specific value, idle rotation of the driving gear 108 occurs to absorb the speed difference from the platen roller. The other end (the left side in FIG. 14) of the take-up roll 103 is rotatably supported on a bearing section 109 provided on the support frame 106A, but no driving power is imparted to the other end of the take-up roll 103.

In the meantime, a back tension mechanism 104 is provided on the left end of the feed roll 102. The back tension mechanism 104 has a driving gear 112 which is meshed with a gear 111 coaxially mounted on one end (the left side in FIG. 14) of a spindle 102A of the feed roll 102. A specific driving power is given to the driving gear 112. The end of the feed roller 102 on the opposite side of the back tension mechanism 104 is only rotatably supported on a bearing 110 mounted on the support frame 106B, and is not imparted with the driving power.

With the impartment of the driving power to the driving gear 112, the back tension mechanism 104 gives a specific rotation force to the spindle 102A of the feed roll 102 in the direction of the arrow Z which is opposite to the direction of rotation Y of the take-up roll 103. Then, a force in the direction of feed (the direction of the arrow X) from the friction mechanism 105 and a force in the reverse direction (the opposite direction of the arrow X) of feed from the back tension mechanism 104 act on the ink ribbon 101.

As the friction mechanism 105 and the back tension mechanism 104 operate, the ink ribbon 101 is held with a fixed tension between the feed roll 102 and the take-up roll 103, thereby preventing the ink ribbon 101 from being broken and slacking.

In the conventional ink ribbon feed mechanism, however, the friction mechanism 105 and the back tension mechanism 104 are positioned on the opposite side in the direction of travel (the direction of the arrow X) of the ink ribbon 101. That is, as shown in FIG. 14, the friction mechanism 105 and the back tension mechanism 104 are arranged in diagonal positions of the wide ink ribbon 101. That is, in FIG. 14, the friction mechanism 105 is disposed on the right side, while the back tension mechanism 104 on the left side. Therefore, when the ink ribbon 101 is taken up, the driving power from the friction mechanism 105 for taking up the ink ribbon 101 and the driving power from the back tension mechanism 104 are on the opposite end of the ink ribbon 101. Thus, a twisting force occurs with the ink ribbon 101, producing a crease in the ink ribbon 101. A crease, if any in the ink ribbon 101, will deteriorate or unstabilize printing quality.

Furthermore, since the driving mechanism and the gear mechanism are disposed at opposite sides of the ink ribbon 101, the ink ribbon feed mechanism itself will increase in width. This has been a disturbance to space saving.

Further, the conventional ink ribbon feed mechanism includes a separation segment (not shown) provided between the recording head and the take-up roll 103 for separating the ink ribbon 101 from the recording sheet, the ink ribbon being pressed and heated at a position between the recording head and the platen roller for transferring an inked image onto the recording sheet. The separation segment is formed of a material, such as a resin, the same as that of a bottom side main body cover or a frame and is provided integrally therewith to enhance productivity. The separation segment has an elongated sliding surface extending in parallel with the rotation shaft 103A of the take-up roll 103. The sliding surface is positioned underneath and in contact with the ink ribbon to apply tension thereto, so that the ink ribbon can be separated from the recording sheet fed at an upper side of the ink ribbon. Accordingly, a combination of the friction mechanism 105, the back tension mechanism 104 and the separation segment will provide a given tension to the ink ribbon and separation effect of the ink ribbon from the recording sheet, to thus prevent the ink ribbon from being cut and slacking. Accordingly, it is desirable to provide a separation segment capable of providing a desirable tension of the ink ribbon.

SUMMARY OF THE INVENTION

In view of the above-described problems, it is an object of the present invention to provide an ink ribbon feeder of an image forming apparatus which is capable of stabilizing printing quality by eliminating crease and slack of an ink ribbon.

Another object of the present invention is to provide such ink ribbon feeder having a compact size and produced at a low cost.

Still another object of the present invention is to provide such ink ribbon feeder having a separation segment capable of producing a desirable tension distribution of the ink ribbon.

These and other objects of the present invention will be attained by an ink ribbon feeder for feeding an ink ribbon in an ink ribbon feeding direction including a feed roll, a take-up roll, a feed roll support section, a take-up roll support section, a first driving section, a second driving section, a recording unit, a tension adjusting member, and adjusting means. The feed roll winds thereover the ink ribbon. The ink ribbon has a first edge and a second edge extending in the ribbon feeding direction and determining a width of the ink ribbon therebetween. The take-up roll is positioned downstream of the feed roll in the ink ribbon feeding direction for taking up the ink ribbon fed from the feed roll. The feed roll support section is adapted for rotatable supporting the feed roll. The take-up roll support section is adapted for rotatable supporting the take-up roll. The first driving section is drivingly connected the take-up roll for rotating the take-up roll in a ribbon take-up direction. The second driving section is drivingly connected to the feed roll for rotating the feed roll in a direction opposite the ribbon take-up direction. The recording unit is provided between the feed roll and the take-up roll and is positioned below the ink ribbon and in contact therewith for forming an inked image on a recording medium while pressing the ink ribbon toward the recording medium. The tension adjusting member is provided between the feed roll and the take-up roll and has an upper portion formed with an elongated sliding surface extending in a direction perpendicular to the ink ribbon feeding direction. The tension adjusting member has a first end at a side of the first edge and a second end at a side of the second edge. The sliding surface is in sliding contact with a lower surface of the ink ribbon for applying tension thereto. The adjusting means adjusts a height of at least one of the first end and the second end of the tension member relative to the recording unit for equalizing distribution of a tension of the ink ribbon in the width of the ink ribbon.

DETAILED DESCRIPTION OF THE PREFERRED EMBODIMENTS

Figure 1:
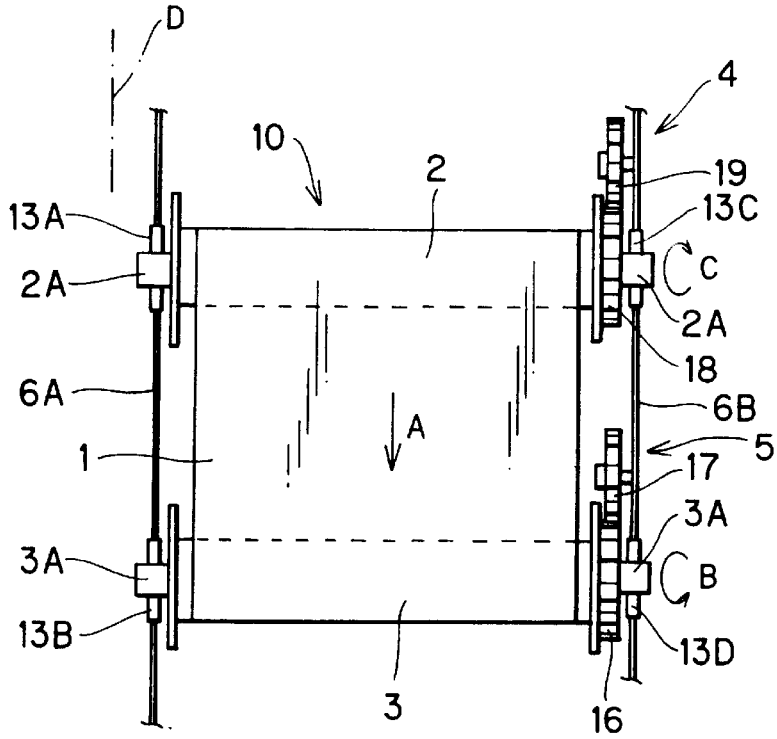
FIG. 1 is a plan view showing an ink ribbon feeder according to a first embodiment of the present invention.

An ink ribbon feeder 10 in a facsimile apparatus according to a first embodiment of the present invention will be described with reference to FIGS. 1 through 4.

An ink ribbon 1 is formed as an elongated medium having a width of about 218 mm which is capable of printing on an A4-size recording paper. One end of the ink ribbon 1 is wound on a feed roll 2, while the other end, on a take-up roll 3. A new ribbon 1 is fed out from the feed roll 2, advancing in the direction of an arrow A in FIG. 1 with a predetermined tension between the feed roll 2 and the take-up roll 3, thus being used in printing. The ink ribbon 1 that has been used in printing is taken up onto the take-up roll 3.

Figure 4:
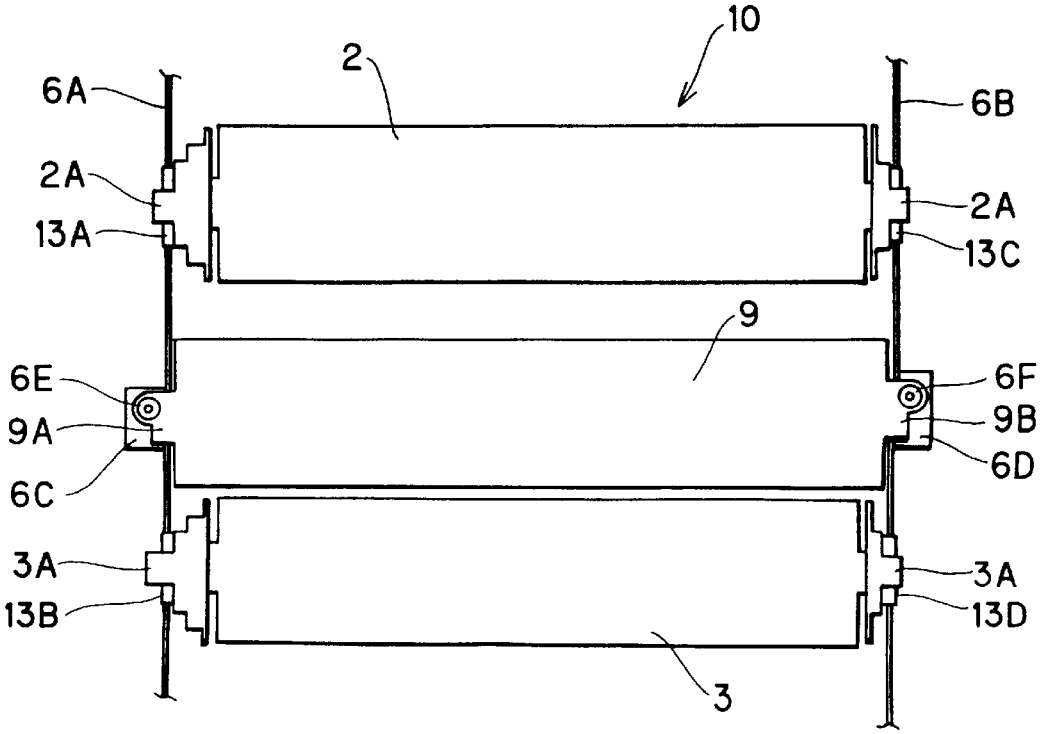
FIG. 4 is a plan view showing an arrangement of a feed roll, a take-up roll, and a recording unit of the ink ribbon feeder shown in FIG. 1.

The feed roll 2 and the take-up roll 3 are both supported approximately horizontally with respect to a bottom plate (not shown) of a facsimile apparatus by support frames 6A and 6B vertically extending from the bottom plate. The support frames 6A and 6B are plate-like members of the same shape. As shown in FIG. 4, bearings 13A and 13B are formed on the support frame 6A, and bearings 13C and 13D are formed on the support frame 6B. A spindle 2A of the feed roll 2 is supported at both ends on the bearings 13A and 13C. The spindle 3A of the take-up roll 3 is supported at both ends on the bearings 13B and 13D.

As shown in FIG. 4, a bracket 6C is formed on the support frame 6A, and a bracket 6D, on the support frame 6B. Each bracket 6C and 6D is formed with a screw hole. A recording unit 9 is supported by the brackets 6C and 6D. That is, the recording unit 9 has each end 9A and 9B formed with screw holes, and screws 6E and 6F are threadingly engaged with the screw holes of the bracket 6C, 6D and the end portion 9A, 9B to fixedly secure the recording unit 9 to the brackets 6C, 6D. The recording unit 9 includes a thermal head (not shown) formed in a known shape of line, and is arranged such that it faces the ink ribbon 1.

Figure 2:
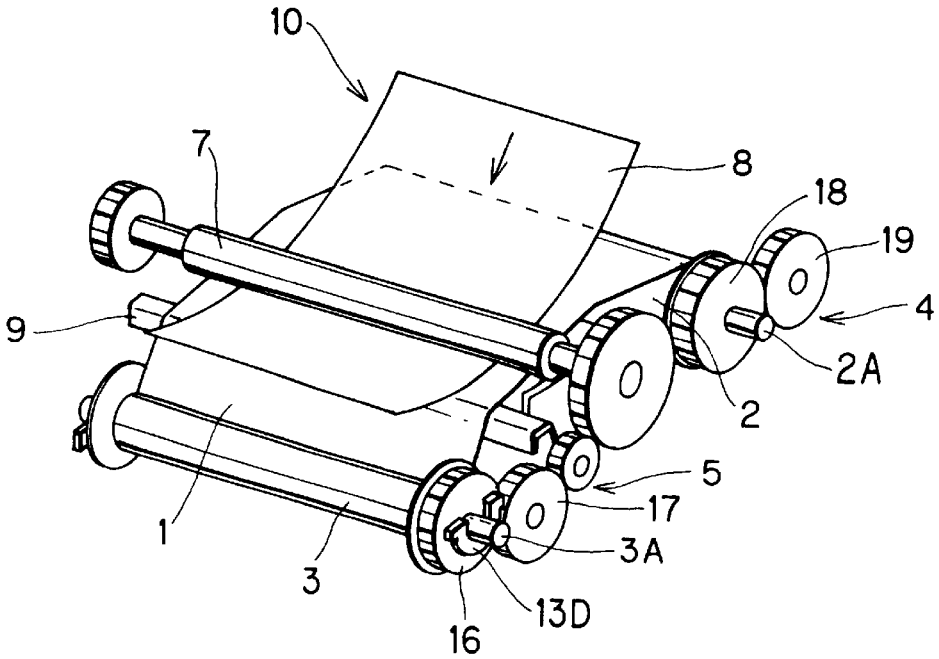
FIG. 2 is a perspective view of the ink ribbon feeder shown in FIG. 1.
Figure 3:
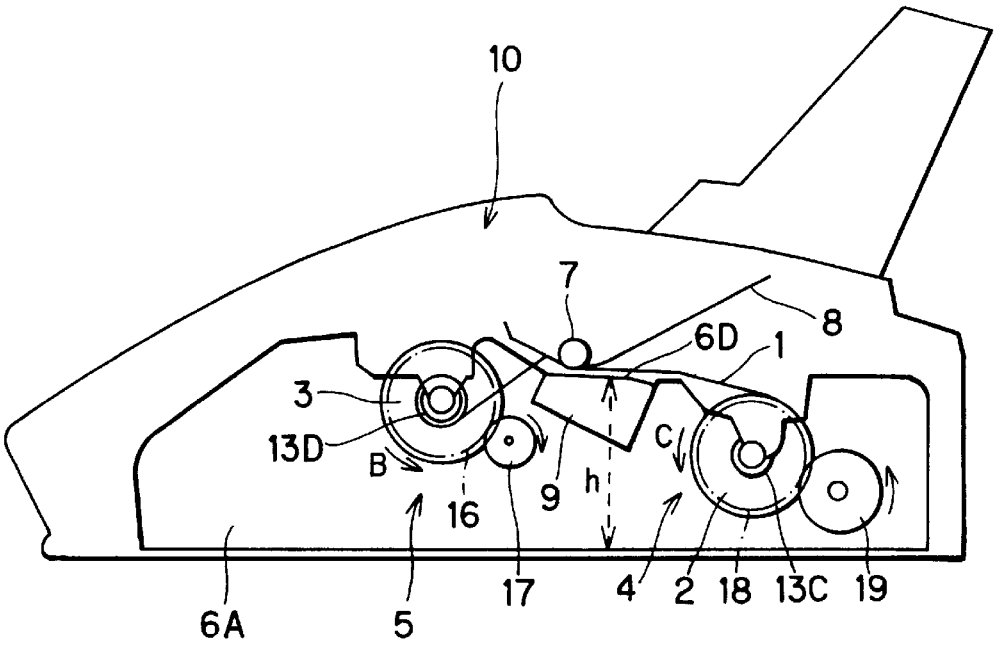
FIG. 3 is a side view of the ink ribbon feeder shown in FIG. 1.

As shown in FIGS. 2 and 3, there is mounted a platen roller 7, above the ink ribbon 1 stretched between the feed roll 2 and the take-up roll 3, for carrying the paper 8 while pressing the paper 8 against the recording unit 9. Between the paper 8 and the recording unit 9 the ink ribbon 1 is present. The ink ribbon 1 is coated with ink on one side, and is wound on the feed roll 2 in such a manner that the ink-coated side will contact the paper 8.

If the thermal head of the recording unit 9 is heated according to a printing data when the paper 8 is being carried by the platen roller 7 while being pressed against the recording unit 9, the ink coated on the ink ribbon 1 is melted with the heat, and the molten ink is transferred to the paper 8, thus producing an inked image on the paper 8 in accordance with the printing data.

The operation of taking-up the ink ribbon 1 is effected by a friction mechanism 5 which drives the take-up roll 3. The friction mechanism 5 has a driving gear 17 which meshes with a gear 16 which is coaxially mounted on one end (the right side in FIG. 1) of the spindle 3A of the take-up roll 3. The driving gear 17 receives a specific driving power from a driving motor (not shown). With the rotation of the driving gear 17, the take-up roll 3 rotates in the direction of an arrow B, moving the ink ribbon 1 in the direction of an arrow A to take up the ink ribbon 1 onto the take-up roll 3.

If, however, the driving gear 17 is driven at a fixed speed of rotation, the amount of the ink ribbon 1 taken up on the take-up roll 3 increases (namely, the diameter of the take-up roll 3 on which the ink ribbon 1 is being taken up increases), thereby increasing the take-up speed of the ink ribbon 1. This, however, will cause a difference between the rotational speed of the platen roller 7 carrying the recording paper and the ink ribbon take-up speed. To avoid this problem, when a friction force exceeding a specific value is exerted to the driving gear 7, or in other words when the amount of the ink ribbon 1 taken up on the take-up roll 3 has increased so much as to increase a load for rotating the take-up roll 3 over a specific value, idle rotation of the driving gear 17 occurs to thereby absorb the difference of the rotational speed between the take-up roller 3 and the platen roller 7. The other end (the left side in FIG. 1) of the take-up roll 3 is rotatably supported on the bearing section 13B provided on the support frame 6A, but no driving power is imparted to the other end.

In the meantime, there is provided a back tension mechanism 4 on the right end of the feed roll 2, or on the same side as the side where the friction mechanism 5 of the take-up roll 3 is located. The back tension mechanism 4 has a driving gear 19 which meshes with a gear 18 coaxially mounted on the right end of the spindle 2A of the feed roll 2. A specific driving power is given to the driving gear 19 for rotating the feed roll 2 in the direction of an arrow C which is opposite to the direction B of rotation of the take-up roll 3. The end of the feed roller 2 on the opposite side of the back tension mechanism 4 is rotatably supported only on the bearing 13A provided on the support frame 6A, and therefore does not receive the driving power.

With the driving power being imparted to the driving gear 19, the back tension mechanism 4 gives a specific rotation force to the feed roll 2 in the direction of the arrow C which Is opposite to the direction B of rotation of the take-up roll 3. Then, the ink ribbon 1 is applied with both a force from the friction mechanism 5 in the direction of movement (the direction of the arrow A) of the ink ribbon 1 and a force from the back tension mechanism 4 in the opposite direction (the opposite direction of the arrow A) of the ribbon movement.

Between the feed roll 2 and the take-up roll 3 the ink ribbon 1 is held with a predetermined tension by the friction mechanism 5 and the back tension mechanism 4, thereby preventing breaking and slacking of the ink ribbon 1.

In the ink ribbon feeder 10 of the first embodiment, as heretofore described, the friction mechanism 5 and the back tension mechanism 4 are arranged on the same side of the ink ribbon 1. Therefore, rotational driving force for taking up the ink ribbon 1 and the rotation preventive force acting on the feed roll 2 are at the same side (the right side in the example) of the ink ribbon 1 in relation to the direction A of movement of the ink ribbon 1. Therefore, the ink ribbon 1 will not be subjected to a twisting force likely to occur in the conventional feeder, thus enabling to prevent the ink ribbon from being creased, and consequently enabling to stabilize the printing quality.

Furthermore, since the friction mechanism 5 and the back tension mechanism 4 are arranged on the same side (the right side in the example) in the first embodiment, entire width of the ribbon feeder 10 can be reduced. For example, in FIG. 1, a chain line D shows a left side position of the conventional ribbon feeder where the back tension mechanism is provided at a left side of the ink ribbon. Therefore, it is possible to locate the support frame 6A close to the ink ribbon 1 side. It, therefore, is possible to reduce the width of the ink ribbon feed mechanism 10, thus enabling decrease in size of a ribbon cassette (not shown) for accommodating the ink ribbon 1 and furthermore reducing the production cost of the feeder.

Figure 5:
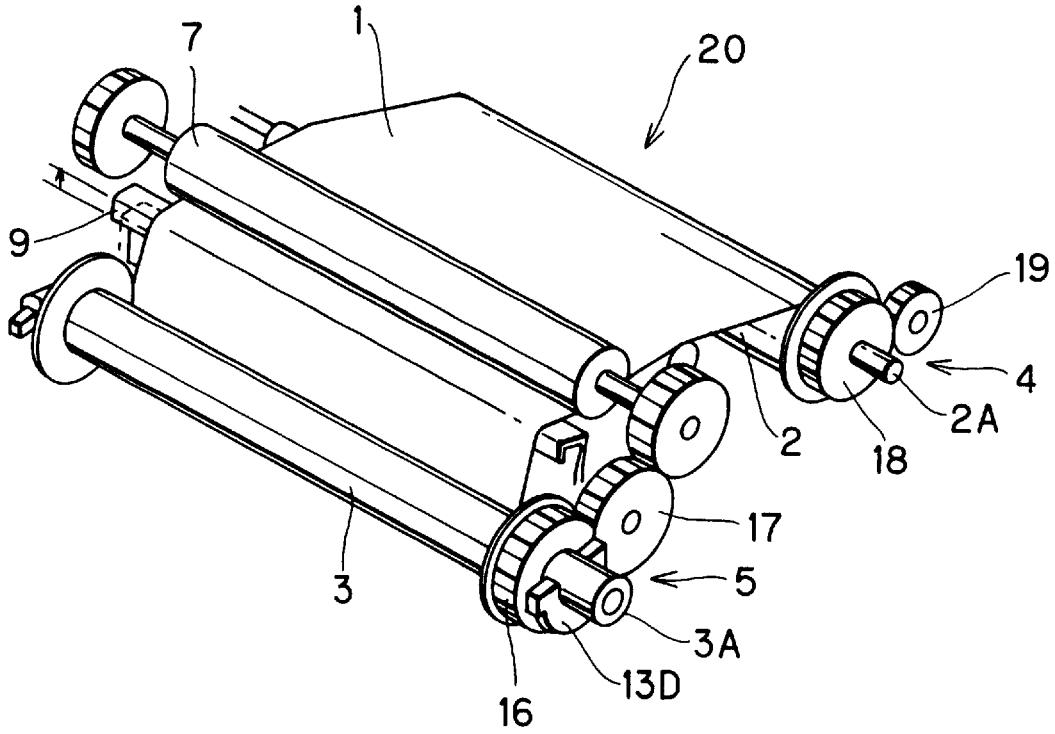
FIG. 5 is a perspective view showing an ink ribbon feeder according to a second embodiment of the present invention.

A ribbon feeder 20 according to a second embodiment of the present invention will next be described with reference to FIGS. 5 and 6. In the first embodiment described above, the friction mechanism 5 for operation to take up the ink ribbon 1 and the back tension mechanism 4 for imparting a specific tension to the ink ribbon 1 are arranged on the same side of the ink ribbon 1. In this case, however, there takes place a slight difference in tension applied to the ink ribbon 1 between the side on which the friction mechanism 5 and the back tension mechanism 4 are mounted and the side on which these mechanisms are not mounted. That is, on one side where these two mechanisms are mounted, the ink ribbon 1 is constantly applied with a fixed tension by means of the friction mechanism 5 and the back tension mechanism 4. On the other hand, tension is not positively applied on the other side without these mechanisms, but the tension positively imparted at one side of the ink ribbon is propagated to the other side. Therefore, the tension on the other side without these mechanisms, particularly at the end of the ink ribbon 1, is less than the tension on the side provided with these mechanisms. Therefore, particularly at the end of the ink ribbon 1 on the side without the friction mechanism 5 and the back tension mechanism 4, a lack of tension will occur, which may cause the ink ribbon 1 to crease. To cope with these drawbacks, in the second embodiment, not only the friction mechanism 5 and the back tension mechanism 4 are mounted on the same one side of the ink ribbon 1, but also a compensation arrangement is provided for compensating a lack of tension of the other side of the ink ribbon 1 where the friction mechanism 5 and the back tension mechanism 4 are not provided.

The ink ribbon feeder 20 is approximately the same in constitution as that of the first embodiment, but is different in the constitution that the recording unit 9 is slantingly provided such that it contacts the ink ribbon 1 at a higher position on the left side than on the right side on which the friction mechanism 5 and the back tension mechanism 4 are provided (The height "h" is shown in FIG. 3).

Figure 6:
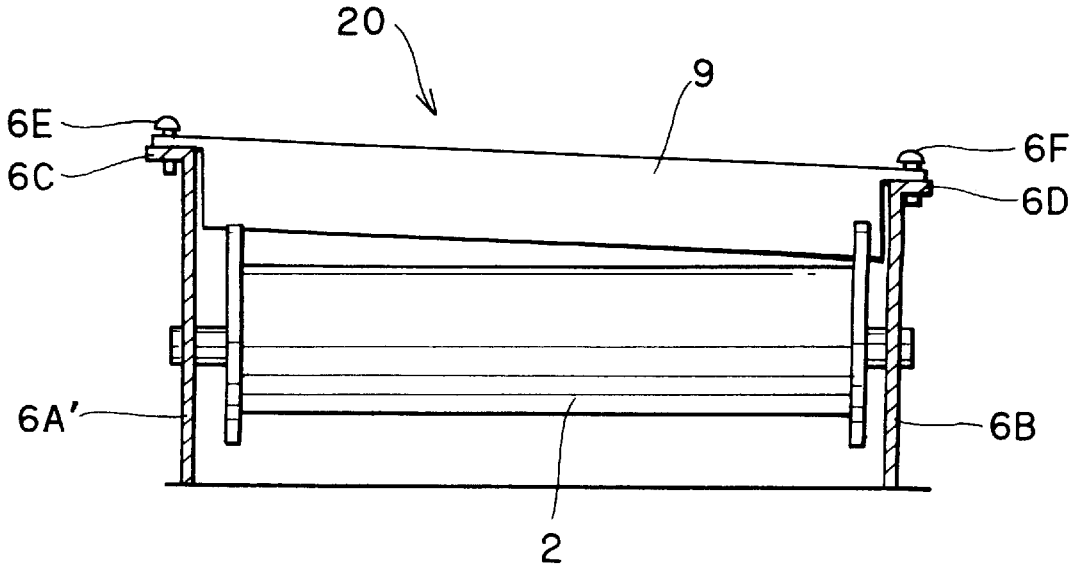
FIG. 6 is a front view of the ink ribbon feeder shown in FIG. 5.

Namely, the recording unit 9 is supported on the frames 6A and 6B, higher as it goes leftwards as viewed from the front in FIG. 6. The feed roller 2, the take-up roller 3, and the platen roller 7 are supported on the support frames 6A and 6B in such a manner that, similarly to the first embodiment, these members will be approximately parallel with the bottom plate of the main body of the facsimile apparatus.

More specifically, a support frame 6A' is so formed that the bracket section 6C of the support frame 6A' on which side the friction mechanism 5 and the back tension mechanism 4 are not mounted is higher than the bracket section 6D of the support frame 6B on which side these mechanisms are mounted.

Therefore the ink ribbon 1 is supported in a higher position at the left end of the recording unit 9 than at the right end, thereby increasing the ink ribbon tension in the vicinity of the left end. This arrangement can level the tension distribution of the ink ribbon 1 over its entire width, reducing the possibility of occurrence of creases in the vicinity of the left end of the ink ribbon 1.

Figure 7:
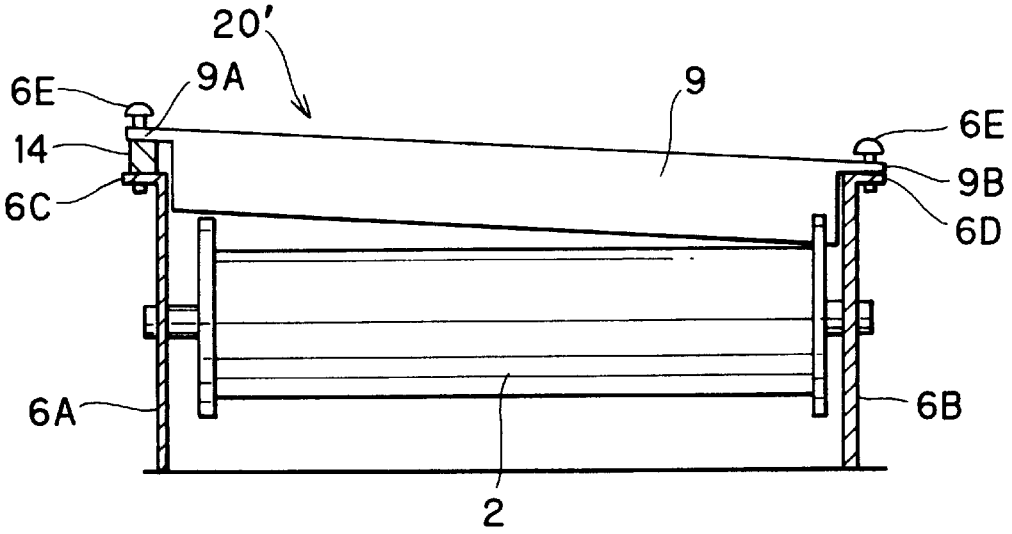
FIG. 7 is a front view of showing a modification to the second embodiment.

FIG. 7 shows a modification 20' to the second embodiment. According to the modification 20', the support frames 6A and 6B of the same type as those of the first embodiment are used in place of changing the shape of the support frame 6A' shown in FIG. 6, and a spacer 14 of suitable thickness is inserted between the bracket section 6C of the support frame 6A and the left end section 9A of the recording unit 9, so that the recording unit 9 can be arranged higher on the left side than on the right side. With this arrangement, it is possible to compensate a lack of tension on the left side where the friction mechanism 5 and the back tension mechanism 4 are not mounted. According to the modification, the tension to be applied to the entire part of the ink ribbon 1 can be brought closer to a uniform tension, thereby enabling largely reducing the possibility of crease occurrence. Furthermore, because the support frames 6A and 6B are plate-like members of the same configuration, the manufacturing cost of the feeder can be decreased.

According to experiments using an about 218 mm wide ink ribbon 1 which is able to record on the A4-size recording paper 8, it is preferable to increase, by 0.6 mm to 1.2 mm, the height of the side on which the friction mechanism 5 and the back tension mechanism 4 are not provided. That is, the left end 9A is preferably set from 0.6 mm to 1.2 mm higher than the right end 9B.

A ribbon feeder 30 according to a third embodiment of this invention will next be described with reference to FIG. 8. The third embodiment is similar to the second embodiment in the respect of such a feeder constitution that a lack of tension of the ink ribbon 1 on the side where the friction mechanism 5 and the back tension mechanism 4 are not mounted is corrected, and that the tension applied to the entire part of the ink ribbon 1 stretched between the feed roll 2 and the take-up roll 3 is brought closer to a uniform tension.

Figure 8:
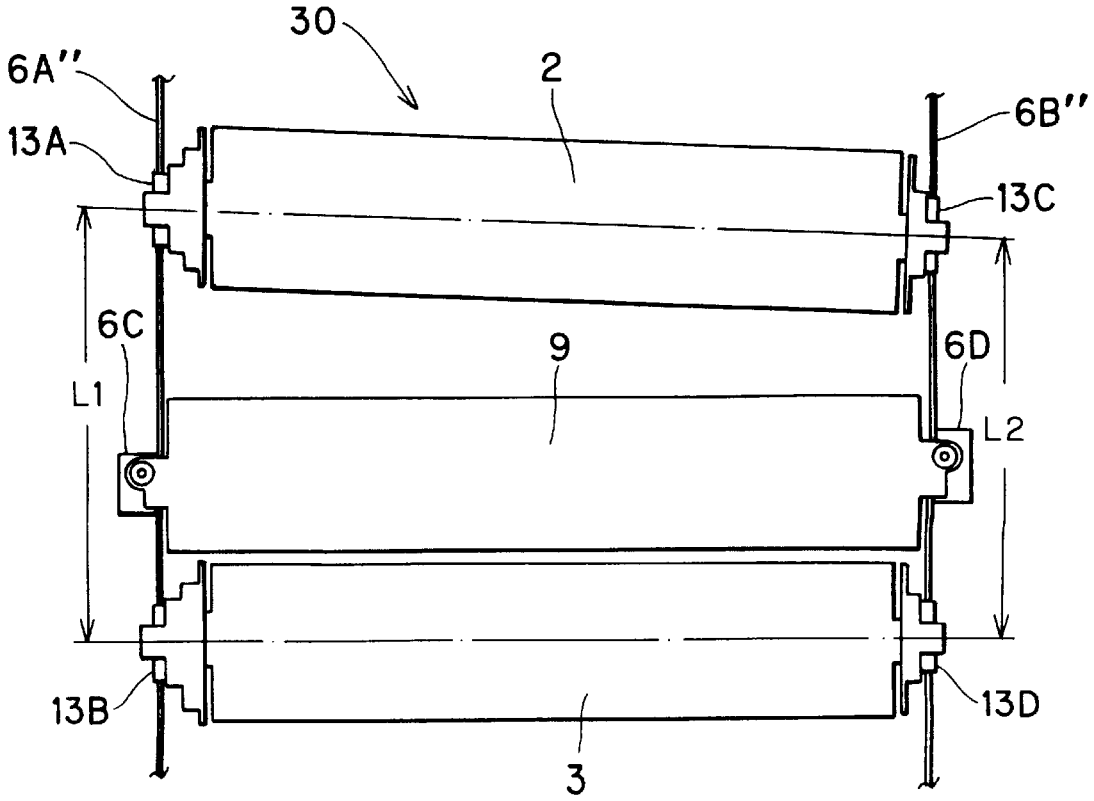
FIG. 8 is a plan view showing an ink ribbon feeder according to a third embodiment of the present invention.

In the ink ribbon feeder 30 of the third embodiment, the feed roll 2 and the take-up roll 3 are not parallelly arranged as shown in FIG. 8. Concretely, the take-up roll 3 and the recording unit 9 are arranged approximately parallelly in a plan view so that these extend in a direction perpendicular to the ribbon take-up direction A. However, the feed roll 2 does not extend in a direction perpendicular to the feeding direction A. That is, the feed roll 2 is disposed such that a distance L2 between the feed roll 2 and the take-up roll 3 on the side where the friction mechanism 5 and the back tension mechanism 4 are mounted is shorter than a distance L1 between the left end of the feed roll 2 and the left end of the take-up roll 3, i.e., on the side where these mechanisms are not mounted.

The above-described decrease in the distance L2 can be realized by moving the position of the bearing section 13A supporting the feed roll 2 on a support frame 6A" to the rear of the position of the bearing section 13C supporting the feed roll 2 on a support frame 6B". That is, the left end of the feed roll 2 is moved backwards, and other take-up roll 3, recording unit 9, and platen roll 7 are held nearly in parallel with the bottom plate of the body of the facsimile apparatus similarly to the first embodiment, whereby the distance between the feed roll 2 and the take-up roll 3 increases on the left side of the feeder, enabling to increase the tension of the ink ribbon 1 in the vicinity of the left end and accordingly to correct a lack of tension.

Thus it becomes possible to bring the tension of the whole area of the ink ribbon 1 stretched between the feed roll 2 and the take-up roll 3 closer to a uniform value, and to largely reduce the possibility of occurrence of creases in the ink ribbon 1.

In the third embodiment in which the feed roll 2 mounted obliquely is given as an example, the feed roll 2 is supported nearly in parallel with the platen roller 7 and others, while the take-up roll 3 may be arranged diagonally. That is, either of the feed roll 2 and the take-up roll 3 may be arranged diagonally so long as the unwinding of the ink ribbon 1 from the feed roll 2 or the winding of the ink ribbon 1 onto the take-up roll 3 are not disturbed. Further, it should be noted that, in the first to third embodiments, the friction mechanism 5 and the back tension mechanism 4 are arranged on the right side. However, these can be arranged exclusively on the left side instead of the right side.

Figure 10:
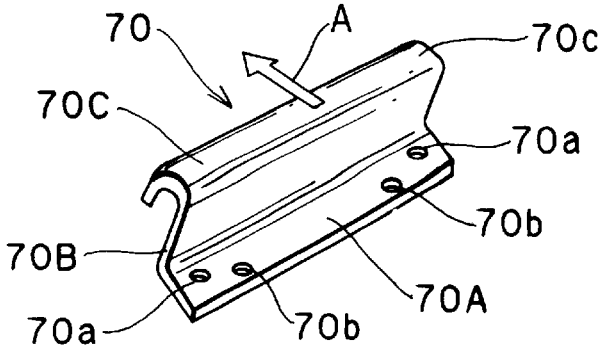
FIG. 10 is a perspective view showing a separation segment used in the fourth embodiment.
Figure 11:
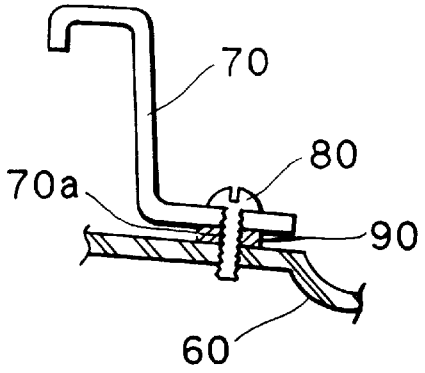
FIG. 11 is a cross-sectional view showing a fixing arrangement for fixing the separation segment according to the fourth embodiment.

A ribbon feeder 40 according to a fourth embodiment will be described with reference to FIGS. 9 through 11. The fourth embodiment pertains to an improvement on a separation segment 70 for separating the ink ribbon 1 from the recording paper 8.

Figure 9:
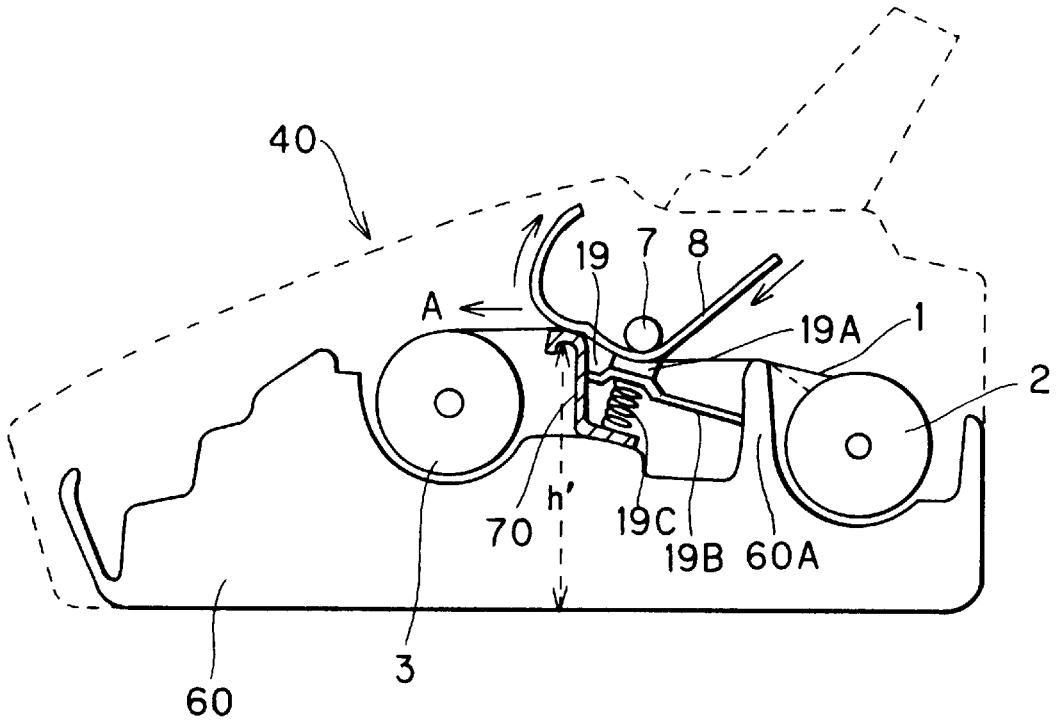
FIG. 9 is a side view showing an ink ribbon feeder according to a fourth embodiment of the present invention.

As shown in FIG. 9, the ribbon feeder 40 has a separation segment 70 provided to a support frame 60 at a position between the platen roller 7 and the take-up roll 3 in the sheet feeding direction A for applying a given tension to the ink ribbon 1 and for separating the ink ribbon 1 from the image carrying recording paper 8. The support frame 60 is adapted to support the take-up roll 3 and the feed roll 2 similar to the support frames 6A, 6B, etc. of the foregoing embodiments. The support frame 60 has a rib 60A extending upwardly at a position between the feed roll 2 and the platen roller 7 in the sheet feed direction A and in contact with the ink ribbon 1 for applying tension to the ink ribbon 1. The rib 60A is provided integrally with the support frame 60 made of a resin material. A recording unit 19 including a recording head 19A is not fixedly secured to the support frame 60 but is supported on a support plate 19B movably fixed to the rib 60A. Further, a biasing spring 19C is provided between the support frame 60 and the support plate 19B for urging the recording head 19A toward the platen roller 7. The support frame 60 also has a pair of positioning projections (not shown) for positioning the separation segment 70.

The separation segment 70 has a lower horizontal section 70A, an intermediate vertical section 70B, and an upper horizontal section 70C. The lower horizontal section 70A is formed with a pair of thread holes 70*a*, 70*a* and a pair of positioning holes 70*b*,70*b* engageable with the positioning projections. The pair of thread holes 70*a*, 70*a* are positioned adjacent end portion of the lower horizontal section 70A. An upper surface of the upper horizontal section 70C serves as an elongated sliding surface 70*c* extending in a direction perpendicular to the ribbon take-up direction A. The sliding surface 70*c* is in contact with a lower surface of the ink ribbon 1 to apply tension thereto as well as to separate the ink ribbon 1 from the recording paper 8.

Adjusting segments including a spacer 90 and a screw 80 are provided for adjusting height of one end of the separation segment 70 with respect to the recording unit 19. As shown in FIG. 11, the spacer 90 having a predetermined thickness is interposed between the one end portion of the lower horizontal section 70A of the separation segment 70 and the support frame 60. Further, the screw 80 is threadingly engaged with the screw hole 70*a* of the lower horizontal section 70A and is also threadingly engaged with the support frame 60. On the other hand, the spacer 90 is not interposed between the other end portion of the lower horizontal section 70A and the support frame 60. The other end portion of the lower horizontal section 70A is merely fixed to the support frame 60 by engaging another screw 80 with the other screw hole 70*a* and with the support frame 60. By selecting a thickness of the spacer 90, the sliding surface 70*c* of the separation segment 70 can provide an optimum inclination to provide an optimum tension to the ink ribbon 1 and suitable separation effect. Alternatively, two spacers having thickness different from each other can be used for the inclination adjustment. That is, one of the spacers is set at one end portion of the lower horizontal section 70A, whereas the other spacer is set at the other end portion of the lower horizontal section 70A, and each end portion of the lower horizontal section 70A is respectively fixed by the screw 80.

Thickness of the spacer 90 is determined by investigation of the printing quality during production of the facsimile machine. That is, spacers having various thickness are prepared, and printing is performed each time each spacer is set to the facsimile machine. A specific spacer which provided lesser slack and wrinkles of the ink ribbon or which provided sufficient printing quality is selected in a subsequent production line.

Figure 12:
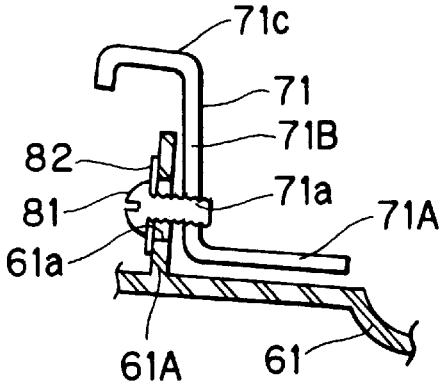
FIG. 12 is a cross-sectional view showing a modification to a fixing arrangement for fixing the separation segment.

FIG. 12 shows a modification to an adjusting arrangement. A separation segment 71 has an upstanding intermediate section 71B formed with a thread hole 71*a* at each end thereof. On the other hand, a lower horizontal section 71A is not formed with any thread hole. A support frame 61 has an upstanding rib 61A at a position between the platen roller 7 and the take-up roll 3. At one end portion of the upstanding rib 61A, a vertically extending slot 61*a* is formed at a position confrontable with one thread hole 71*a*. Another end portion of the upstanding rib 61A is formed with a screw hole (not shown). A screw 81 extends through the vertically extending slot 61*a* with interposing a washer 82 between a head of the screw 81 and the upstanding rib 61A. The screw 81 is threadingly engaged with the thread hole 71*a*, to thus fix the separation segment 71 to the support frame 61. By controlling the relative position between the screw 81 and the vertically extending slot 61*a*, the fixing position of the separation segment 71 can be adjusted. On the other hand, at the other end portion of the separation segment 71, another screw (not shown) is threadingly engaged with the thread holes of the upstanding rib 61A and the intermediate vertical section 71B to fix the other end of the separation segment 71 to the support frame 61. Accordingly, a desirable inclination of a sliding surface 71*c* can be provided.

Alternatively, instead of the thread hole at the other end portion of the rib 61A, a vertically extending slot similar to the slot 61*a* can be formed for performing adjustment of the fixing positions at both end portions of the separation segment 71.

Figure 13:
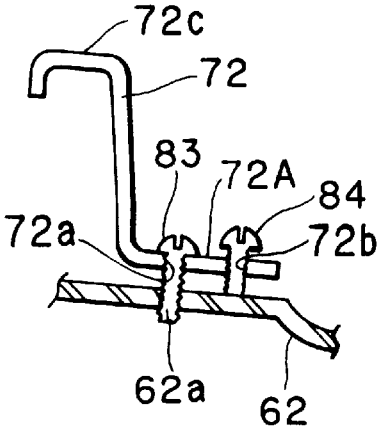
FIG. 13 is a cross-sectional view showing a still another modification to a fixing arrangement for fixing the separation segment.
Figure 14:
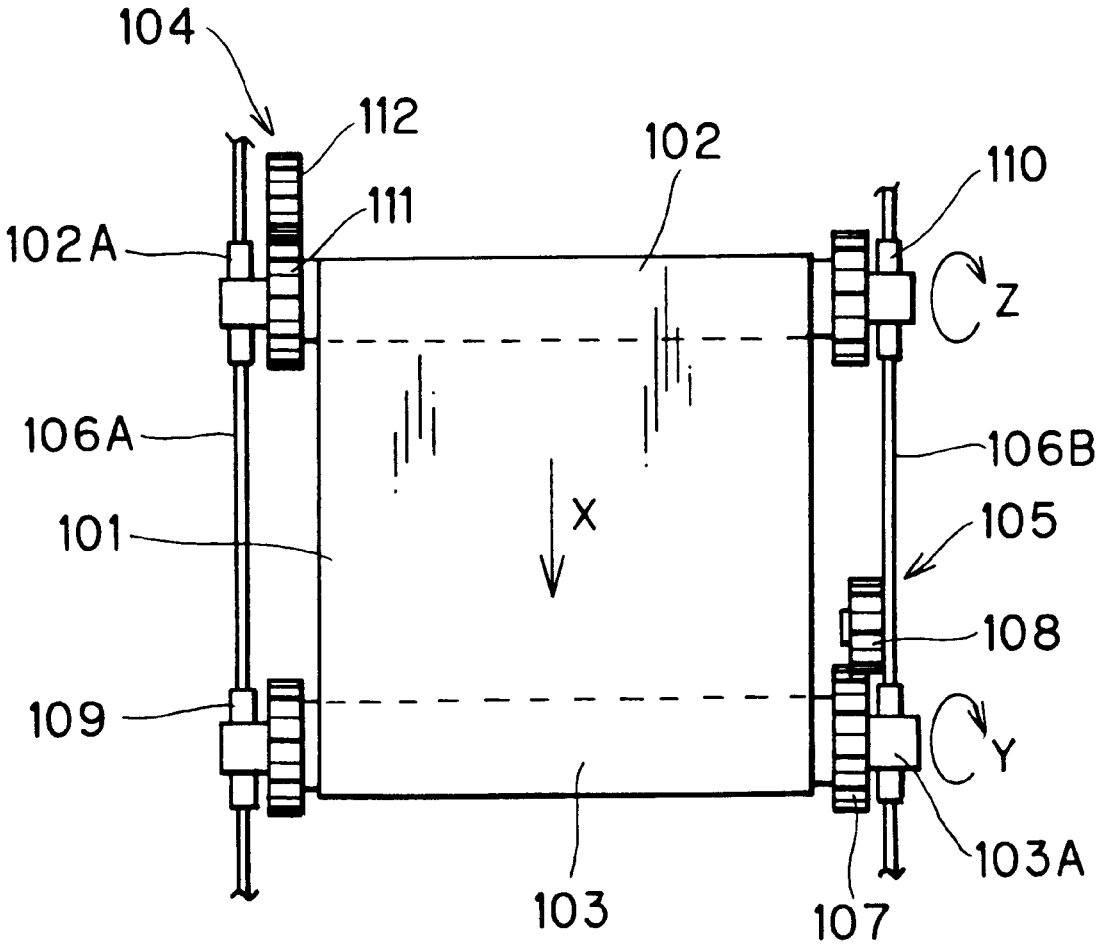
FIG. 14 PRIOR ART
FIG. 14 is a plan view showing a conventional ink ribbon feed mechanism.

FIG. 13 shows another modification to an adjusting arrangement. A separation segment 72 has a lower horizontal section 72A formed with a pair of thread holes 72*a*, 72*b* at one end thereof and a single thread hole 72*a* (not shown) at the other end thereof. A support frame 62 has thread holes 62*a* at positions in confrontation with the thread holes 72*a*. At one end portion of the lower horizontal section 72A, a fixing screw 83 is threadingly engaged with the thread hole 72*a* and 62*a* for fixing the one end portion of the separation segment 72 to the support frame 62. On the other hand, an adjusting screw 84 is threadingly engaged with the thread hole 72*b*, whereas an end face of the adjusting screw 84 is merely seated on the upper surface of the support frame 62.

For adjusting the inclination of a sliding surface 72*c*, the threading rotation of the adjusting screw 84 is adjusted for adjusting a distance between the lower surface of the lower horizontal section 72A and the upper surface of the support frame 62. Then, the fixing screw 83 is threadingly engaged with the thread hole 72*a* and 62*a* to fix the one end of the lower horizontal section 72A to the support frame 62. If necessary, further adjustment is made by rotating the adjusting screw 84. On the other hand, at the other end portion of the lower horizontal section 72A, the screw 83 is merely threadingly engaged with the corresponding thread holes to fix the other end of the lower horizontal section 72A to the support frame 62.

Alternatively, additional thread hole can be formed at the other end of the lower horizontal section to allow a corresponding adjusting screw to be engaged therewith, so that both end portions of the lower horizontal section 72A can perform adjustment of the inclination.

In the fourth embodiment, the rib 60A (FIG. 9) is provided integrally with the support frame 60. However, the rib 60A can be provided separately from the support frame 60, and can be fixed thereto by a screw. In the latter case, the above-described adjusting arrangements for the separation segment 70, 71, 72 are available for adjusting the height of each end portion of the top surface of the rib 60A to adjust inclination of the top surface thereof. In this case, adjusting arrangements can be applied to both the separation segment and the rib. Alternatively, the adjusting arrangement can only be applied to the rib, while the separation segment is merely fixed to the support frame without the adjusting arrangement. In this instance, the separation segment can be provided integrally with the support frame.

According to experiments conducted by the present inventors, height control of the separation segment in the order of 0.1 mm (for example, height difference by 0.5 mm between the right and left top ends of the sliding surface) could provide improvement on elimination of slack and wrinkle of the ink ribbon, and height control of the rib 60A in the order of 1 mm (for example, height difference by 5 to 10 mm between the right and left top ends of the rib 60A could provide the relevant improvement. Accordingly, it could be understood that the control to the separation segment can provide greater change in slack and wrinkles of the ink ribbon rather than control to the rib 60A.

In view of the above, according to the fourth embodiment, the height adjustment of the right and left top ends of the separation segment 70, 71, 72 can be easily performed to level tension distribution over a width of the ink ribbon with a simple construction and by a simple adjusting labor. Further, the adjusting arrangement can be produced at a low production cost. This is advantageous over the height adjustment of the recording unit 9 as is done in the second embodiment, and over an arrangement where a separation segment is provided integrally with the support frame made of a resin. In the latter case, various kinds of integral product must be produced so as to provide various inclination of the separation segment.

While the invention has been described in detail and with reference to the specific embodiments thereof, it would be apparent to those skilled in the art that various changes and modifications may be made therein without departing from the spirit and scope of the invention. For example, the fourth embodiment can be combined with one of the first to third embodiments.

What is claimed is:

1. An ink ribbon feeder for feeding an ink ribbon in an ink ribbon feeding direction, comprising:

a feed roll winding thereover the ink ribbon, the ink ribbon having a first edge and a second edge extending in the ribbon feeding direction and determining a width of the ink ribbon therebetween;

a feed roll support section for rotatably supporting the feed roll;

a take-up roll positioned downstream of the feed roll in the ink ribbon feeding direction for taking up the ink ribbon fed from the feed roll;

a take-up roll support section for rotatably supporting the take-up roll;

a first driving section drivingly connected to the take-up roll for rotating the take-up roll in a ribbon take-up direction;

a second driving section drivingly connected to the feed roll for rotating the feed roll in a direction opposite the ribbon take-up direction;

a recording unit provided between the feed roll and the take-up roll and positioned below the ink ribbon and in contact therewith for forming an inked image on a recording medium while pressing the ink ribbon toward the recording medium;

a tension adjusting member provided between the feed roll and the take-up roll and having an upper portion formed with an elongated sliding surface extending in a direction perpendicular to the ink ribbon feeding direction, the tension adjusting member having a first end at a side of the first edge and a second end at a side of the second edge, and the sliding surface being in sliding contact with a lower surface of the ink ribbon for applying tension thereto;

adjusting means adjusting a height of at least one of the first end and the second end of the tension member relative to the recording unit for equalizing distribution of a tension of the ink ribbon in the width of the ink ribbon; and a support frame supporting the recording unit, the take-up roll support section, and the feed roll support section, the adjusting means being provided at the support frame, wherein the first end of the tension adjusting means has a first upper end and a first lower end, and the second end of the tension adjusting means has a second upper end and a second lower end, and the adjusting means comprises:

a spacer provided between the first lower end and the support frame for increasing a height of the first upper end to change a height between the first and second upper ends;

a first screw engaged with the first lower end and with the support frame interposing the spacer therebetween; and a second screw engaged with the second lower end with the support frame.

2. The ink ribbon feeder as claimed in claim 1, wherein the adjusting means further comprises a second spacer provided between the second lower end and the support frame, the second spacer having a width different from a width of the first spacer, the second screw being engaged with the second lower end and with the support frame interposing therebetween the second spacer.

3. An ink ribbon feeder for feeding an ink ribbon in an ink ribbon feeding direction, comprising:

a feed roll winding thereover the ink ribbon, the ink ribbon having a first edge and a second edge extending in the ribbon reeding direction and determining a width of the ink ribbon therebetween;

a feed roll support section for rotatably supporting the feed roll;

a take-up roll positioned downstream of the feed roll in the ink ribbon feeding direction for taking up the ink ribbon fed from the feed roll;

a take-up roll support section for rotatably supporting the take-up roll;

a first driving section drivingly connected to the take-up roll for rotating the take-up roll in a ribbon take-up direction;

a second driving section drivingly connected to the feed roll for rotating the feed roll in a direction opposite the ribbon take-up direction;

a recording unit provided between the feed roll and the take-up roll and positioned below the ink ribbon and in contact therewith for forming an inked image on a recording medium while pressing the ink ribbon toward the recording medium;

a tension adjusting member provided between the feed roll and the take-up roll and having an upper portion formed with an elongated sliding surface extending in a direction perpendicular to the ink ribbon feeding direction, the tension adjusting member having a first end at a side of the first edge and a second end at a side of the second edge, and the sliding surface being in sliding contact with a lower surface of the ink ribbon for applying tension thereto;

adjusting means adjusting a height of at least one of the first end and the second end of the tension member relative to the recording unit for equalizing distribution of a tension of the ink ribbon in the width of the ribbon; and a support frame supporting the recording unit, the take-up roll support section, and the feed roll support section, the adjusting means being provided at the support frame, wherein the support frame has an upwardly extending rib formed with a vertically extending slot, and the adjusting means comprises:

a first screw extending through the vertically extending slot and engaged with the one end of the tension adjusting member for fixing the one end of the tension adjusting member to the upwardly extending rib, a fixing position of the first screw relative to the slot determining a height of the one end of the tension adjusting member; and a second screw engaged with the rib and the other end of the tension adjusting member.

4. The ink ribbon feeder as claimed in claim 3, wherein the rib is formed with a second vertically extending slot, the second screw extending through the second vertically extending slot and engaged with the other end of the tension adjusting member for fixing the other end of the tension adjusting member to the upwardly extending rib, a fixing position of the second screw relative to the second slot determining a height of the other end of the tension adjusting member.

5. An ink ribbon feeder for feeding an ink ribbon in an ink ribbon feeding direction, comprising:

a feed roll winding thereover the ink ribbon, the ink ribbon having a first edge and a second edge extending in the ribbon reeding direction and determining a width of the ink ribbon therebetween;

a feed roll support section for rotatably supporting the feed roll;

a take-up roll positioned downstream of the feed roll in the ink ribbon feeding direction for taking up the ink ribbon fed from the feed roll;

a take-up roll support section for rotatably supporting the take-up roll;

a first driving section drivingly connected to the take-up roll for rotating the take-up roll in a ribbon take-up direction;

a second driving section drivingly connected to the feed roll for rotating the feed roll in a direction opposite the ribbon take-up direction;

a recording unit provided between the feed roll and the take-up roll and positioned below the ink ribbon and in contact therewith for forming an inked image on a recording medium while pressing the ink ribbon toward the recording medium;

a tension adjusting member provided between the feed roll and the take-up roll and having an upper portion formed with an elongated sliding surface extending in a direction perpendicular to the ink ribbon feeding direction, the tension adjusting member having a first end at a side of the first edge and a second end at a side of the second edge, and the sliding surface being in sliding contact with a lower surface of the ink ribbon for applying tension thereto;

adjusting means adjusting a height of at least one of the first end and the second end of the tension member relative to the recording unit for equalizing distribution of a tension of the ink ribbon in the width of the ribbon; and a support frame supporting the recording unit, the take-up roll support section, and the feed roll support section, the adjusting means being provided at the support frame, wherein the first end of the tension adjusting means has a first upper end and a first lower end, and the second end of the tension adjusting means has a second upper end and a second lower end, and the adjusting means comprises:

a first fixing screw for fixing the first lower end to the support frame;

a first adjusting screw engaged with the first lower end and seated on the support frame for adjusting a distance between the first lower end and the support frame by the rotation of the first adjusting screw, so that a height of the first upper end is adjustable; and a second fixing screw for fixing the second lower end to the support frame.

6. The ink ribbon feeder as claimed in claim 5, wherein the adjusting means further comprises a second adjusting screw engaged with the second lower end and seated on the support frame for adjusting a distance between the second lower end and the support frame by the rotation of the second adjusting screw, so that a height of the second upper end is adjustable.

7. An ink ribbon feeder for feeding an ink ribbon in an ink ribbon feeding direction, comprising:

a feed roll winding thereover the ink ribbon, the ink ribbon having a first edge and a second edge extending in the ribbon reeding direction and determining a width of the ink ribbon therebetween;

a feed roll support section for rotatably supporting the feed roll;

a take-up roll positioned downstream of the feed roll in the ink ribbon feeding direction for taking up the ink ribbon fed from the feed roll;

a take-up roll support section for rotatably supporting the take-up roll;

a first driving section drivingly connected to the take-up roll for rotating the take-up roll in a ribbon take-up direction;

a second driving section drivingly connected to the feed roll for rotating the feed roll in a direction opposite the ribbon take-up direction;

a recording unit provided between the feed roll and the take-up roll and positioned below the ink ribbon and in contact therewith for forming an inked image on a recording medium while pressing the ink ribbon toward the recording medium;

a tension adjusting member provided between the feed roll and the take-up roll and having an upper portion formed with an elongated sliding surface extending in a direction perpendicular to the ink ribbon feeding direction, the tension adjusting member having a first end at a side of the first edge and a second end at a side of the second edge, and the sliding surface being in sliding contact with a lower surface of the ink ribbon for applying tension thereto;

adjusting means adjusting a height of at least one of the first end and the second end of the tension member relative to the recording unit for equalizing distribution of a tension of the ink ribbon in the width of the ribbon; and a support frame supporting the recording unit, the take-up roll support section, and the feed roll support section, the adjusting means being provided at the support frame, the support frame having an upwardly projecting rib at a position between the recording unit and the feed roll, and the upwardly projecting rib having a top end surface in contact with the ink ribbon.

8. An ink ribbon feeder for feeding an ink ribbon in an ink ribbon feeding direction, comprising:

a feed roll winding thereover the ink ribbon, the ink ribbon having a first edge and a second edge extending in the ribbon reeding direction and determining a width of the ink ribbon therebetween;

a feed roll support section for rotatably supporting the feed roll;

a take-up roll positioned downstream of the feed roll in the ink ribbon feeding direction for taking up the ink ribbon fed from the feed roll;

a take-up roll support section for rotatably supporting the take-up roll;

a first driving section drivingly connected to the take-up roll for rotating the take-up roll in a ribbon take-up direction;

a second driving section drivingly connected to the feed roll for rotating the feed roll in a direction opposite the ribbon take-up direction;

a recording unit provided between the feed roll and the take-up roll and positioned below the ink ribbon and in contact therewith for forming an inked image on a recording medium while pressing the ink ribbon toward the recording medium;

a tension adjusting member provided between the feed roll and the take-up roll and having an upper portion formed with an elongated sliding surface extending in a direction perpendicular to the ink ribbon feeding direction, the tension adjusting member having a first end at a side of the first edge and a second end at a side of the second edge, and the sliding surface being in sliding contact with a lower surface of the ink ribbon for applying tension thereto;

adjusting means adjusting a height of at least one of the first end and the second end of the tension member relative to the recording unit for equalizing distribution of a tension of the ink ribbon in the width of the ribbon; and a support frame supporting the recording unit, the take-up roll support section, and the feed roll support section, the adjusting means being provided at the support frame, wherein the tension adjusting member is positioned downstream of the recording unit in the ink ribbon feeding direction to also serve as a separation member for separating the ink ribbon from the recording sheet which has been printed by a combination of the ink ribbon and the recording unit.

9. The ink ribbon feeder as claimed in claim 8, further comprising a support frame supporting the recording unit, the take-up roll support section, and the feed roll support section, the adjusting means being provided at the support frame.

10. The ink ribbon feeder as claimed in claim 9, wherein the first end of the tension adjusting means has a first upper end and a first lower end, and the second end of the tension adjusting means has a second upper end and a second lower end, and wherein the adjusting means comprises:

a spacer provided between the first lower end and the support frame for increasing a height of the first upper end to change a height between the first and second upper ends;

a first screw engaged with the first lower end and with the support frame interposing the spacer therebetween; and a second screw engaged with the second lower end with the support frame.

11. The ink ribbon feeder as claimed in claim 10, wherein the adjusting means further comprises a second spacer provided between the second lower end and the support frame, the second spacer having a width different from a width of the first spacer, the second screw being engaged with the second lower end and with the support frame interposing therebetween the second spacer.

12. The ink ribbon feeder as claimed in claim 9, wherein the support frame has an upwardly extending rib formed with a vertically extending slot;

and wherein the adjusting means comprises:

a first screw extending through the vertically extending slot and engaged with the one end of the tension adjusting member for fixing the one end of the tension adjusting member to the upwardly extending rib, a fixing position of the first screw relative to the vertically extending slot determining a height of the one end of the tension adjusting member; and a second screw engaged with the upwardly extending rib and the other end of the tension adjusting member.

13. The ink ribbon feeder as claimed in claim 12, wherein the rib is formed with a second vertically extending slot, the second screw extending through the second vertically extending slot and engaged with the other end of the tension adjusting member for fixing the other end of the tension adjusting member to the upwardly extending rib, a fixing position of the second screw relative to the second vertically extending slot determining a height of the other end of the tension adjusting member.

14. The ink ribbon feeder as claimed in claim 9, wherein the first end of the tension adjusting means has a first upper end and a first lower end, and the second end of the tension adjusting means has a second upper end and a second lower end;

and wherein the adjusting means comprises:

a first fixing screw for fixing the first lower end to the support frame;

a first adjusting screw engaged with the first lower end and seated on the support frame for adjusting a distance between the first lower end and the support frame by the rotation of the first adjusting screw, so that a height of the first upper end is adjustable; and a second fixing screw for fixing the second lower end to the support frame.

15. The ink ribbon feeder as claimed in claim 14, wherein the adjusting means further comprises a second adjusting screw engaged with the second lower end and seated on the support frame for adjusting a distance between the second lower end and the support frame by the rotation of the second adjusting screw, so that a height of the second upper end is adjustable.

16. The ink ribbon feeder as claimed in claim 8, further comprising a support frame supporting the recording unit, the take-up roll support section, and the feed roll support section, the adjusting means being provided at the support frame, the support frame having an upwardly projecting rib at a position between the recording unit and the feed roll, and the upwardly projecting rib having a top end surface in contact with the ink ribbon.

* * * * *